United States Patent [19]

Anderson et al.

[11] Patent Number: 4,918,759

[45] Date of Patent: Apr. 24, 1990

[54] TIMEKEEPING CAP

[76] Inventors: Ernest R. Anderson, 5810 Leanne La., McFarland, Wis. 53538; John K. Gahan, 5812 Glenway St., McFarland, Wis. 53558

[21] Appl. No.: 287,494

[22] Filed: Dec. 20, 1988

[51] Int. Cl.[5] ..... A42B 1/02

[52] U.S. Cl. ..... 2/199; 224/903

[58] Field of Search ..... 2/185 R, 186, 196, 199, 2/209.1; 224/903

[56] References Cited

U.S. PATENT DOCUMENTS

| | | | |
|---|---|---|---|
| 1,416,654 | 5/1922 | Lenneberg | 224/903 |
| 1,484,121 | 2/1924 | Ezekiel | 224/903 |
| 2,103,711 | 12/1937 | Cole | 224/903 |
| 2,411,446 | 11/1946 | Mars | 224/903 |
| 4,682,310 | 7/1987 | Lund | 224/903 |
| 4,769,799 | 9/1988 | Matsukage | 224/903 |

*Primary Examiner*—Henry S. Jaudon

*Assistant Examiner*—Diana L. Biefeld

*Attorney, Agent, or Firm*—Lathrop & Clark

[57] ABSTRACT

A timekeeping cap includes a crown portion which may be placed and worn on the head of a human, a visor portion which extends from the crown portion for shade and which has a cavity which opens to the lower surface of the visor portion, and a clock which is positioned substantially within the cavity and which includes a clock face through which time may be viewed. The timekeeping cap preferably also includes some means for retaining the clock within the cavity. The clock face may be substantially flush with the lower surface of the visor portion. The individual with the cap may view the time by removing the cap from his or her head, and holding the cap out in front with the lower surface of the visor portion facing upwardly or rearwardly toward the individual's face so that the clock face can be viewed.

7 Claims, 1 Drawing Sheet

TIMEKEEPING CAP

BACKGROUND OF THE INVENTION

1. Field of the Invention

This invention pertains generally to the field of caps which may be worn on the head, and also to time pieces.

2. Description of the Related Art

Individuals who work outdoors with their hands or participate in sports often find that it is inconvenient to wear a watch. If they work with their hands, a watch may interfere with the work being performed, and may even be dangerous if it is caught in machinery or equipment. A watch may also be inconvenient to wear when golfing, playing softball or basketball, hunting or fishing. Additionally, a watch often can interfere with clothing which is worn such as the arms of a jacket or gloves. As a result, individuals who participate in outdoor activities often do not carry any type of timekeeping device. If they do, the watch often must be kept in their pocket where access to the watch is difficult, particularly if the individual is wearing gloves.

Currently, digital clocks which have an adhesive material on the bottom surface of the clock for attaching the clock to an object are in common use. Although these types of digital clocks might be adhered to the clothing of individuals who participate in outdoor activities, this in fact would not be very practical for at least two reasons. First, the adhesive which is commonly used on such clocks in many cases would not effectively and permanently adhere to clothing on the individual. Secondly, when so attached to the clothing of an individual, the digital clock would project entirely outwardly from the clothing and thus be susceptible to being knocked off the clothing or possibly even interfering with work which is being done, or even being caught in equipment or machinery.

SUMMARY OF THE INVENTION

The present invention is summarized in that a timekeeping cap which may be used both to shade an individual's eyes and also to allow that individual to tell the time, includes a crown portion which may be placed and worn on a human head, and a visor portion which extends from the crown portion for shade. The visor portion includes a lower surface and has a cavity which opens to the lower surface of the visor portion. The timekeeping cap further includes a clock which is positioned substantially within the cavity and which includes a clock face through which time may be viewed. Preferably, the visor portion includes a relatively stiff core and a layer of material such as cloth which substantially covers the core. Near the peripheral portions of the cavity, the layer of material may form flaps which extend at least partially into the cavity between the clock and the core so that no rough ends of the layer of material are exposed. The timekeeping clock preferably includes some means for retaining the clock within the cavity. For example, the retaining means may comprise an adhesive between the core and a portion of the clock which substantially abuts against the core within the cavity.

It is generally preferred that the clock face be substantially flush with the lower surface of the visor portion. In that way, no portion of the clock projects very far outwardly from the cap thereby exposing the clock to being knocked off the cap or interfering with some other object. Alternatively the clock might extend out from the cavity for some distance, since the location of the clock on the cap will likely inherently prevent its being knocked off or interfering with other objects. The placement of the clock substantially within the cavity provides additional strength to the securement of the clock to the cap, and will probably prevent the clock from being knocked off the cap.

It is found that individuals who participate in outdoor activities often wear caps, both to cover their head, and to shade their eyes from the sunlight. This is particularly advantageous in that the cap is an object which is easily taken off the head and viewed. Thus a clock which is placed substantially within a cavity in the cap in a manner which avoids interference with other objects, is a particularly useful and practical timekeeping device for use by individuals who work or participate in sports outdoors.

A primary object of the invention is to provide a timekeeping cap which can be used to shade an individual's eyes and to allow that individual to tell time without a watch.

A second object of the invention is to provide a timekeeping cap with a clock which is not exposed in such a manner that would create a likelihood of interference with other objects.

Another object of the invention is to provide a timekeeping cap in which the clock face can be substantially flush with a commonly existing surface on the cap.

An additional object of the invention is to provide a timekeeping cap on which the clock is secured firmly.

Other objects, features and advantages of the invention will be apparent from the following detailed description when taken in conjunction with the accompanying drawings wherein a preferred embodiment of the invention has been selected for exemplification.

Brief Description of the Drawings FIG. 1 is a perspective view of the preferred timekeeping cap. FIG. 2 is a bottom plan view of the timekeeping cap of FIG. 1. FIG. 3 is a longitudinal section view of the visor portion of the timekeeping cap along section line 3—3 of FIG. 2. FIG. 4 is a longitudinal section view similar to FIG. 3 of the visor portion of a first alternative timekeeping cap. FIG. 5 is a longitudinal section view similar to FIG. 3 of the visor portion of a second alternative timekeeping cap. FIG. 6 is a longitudinal section view similar to FIG. 3 of the visor portion of a third alternative timekeeping cap.

DESCRIPTION OF THE PREFERRED EMBODIMENT

Figure 1:
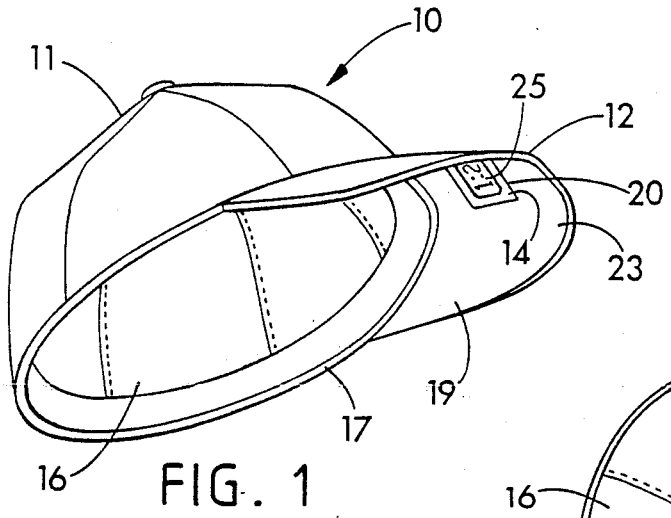
Figure 2:
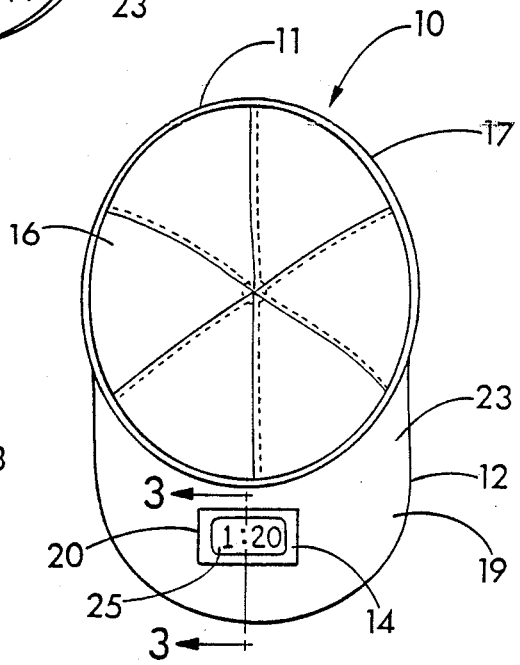

Referring more particularly to the drawings, wherein like numbers refer to like parts, FIG. 1 shows a preferred timekeeping cap 10 which may be worn by an individual to cover the head and protect the eyes from sunlight, and which also can be used to tell time. As shown in FIGS. 1 and 2, the timekeeping cap 10 includes a crown portion 11, a visor portion 12, and a clock 14.

The crown portion may be placed and worn on an individual's head for protection or warmth, or for maintaining the visor portion 12 in position on the head for shade. Although the crown portion 11 shown in FIGS. 1 and 2 has a concave undersurface 16 so that the crown portion covers the individual's head, alternatively the crown portion could be merely band-shaped like a sweatband, or the band on a tennis visor.

Figure 3:
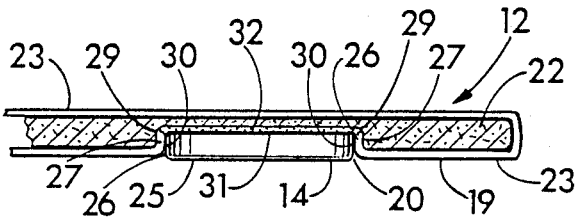

The visor portion 12 extends forwardly from around a lower margin 17 of the crown portion 11 to shade the individual's eyes. The visor portion 12 includes a lower surface 19 and has a centrally located rectangular cavity 20 which extends from the lower surface 19 into the visor portion 12. As shown in FIG. 3, the visor portion 12 is formed from a relatively stiff cardboard core 22, and a layer of cloth material 23 which substantially covers the entire core 22. The cavity 20 actually extends from the lower surface 19 formed by the layer of cloth material 23 partially into the core 22.

The clock 14 is positioned substantially within the cavity 20, and includes a clock face 25 on which the time of the day is displayed. As shown, the clock face 25 is nearly flush or coplanar with the lower surface 19 of the visor portion 12. Near the peripheral portions 26 of the cavity, the layer of material 23 forms flaps 27 which extend snugly into the cavity between the cavity sides 29 and clock sides 30. Thus no cut ends or edges of the layer of material 23 are exposed which otherwise could be damaged or subject to wear. The clock 14 abuts directly against the cavity bottom 31 to which the clock 14 is adhered with an adhesive 32. The adhesive 32 therefore provides a means for retaining the clock 14 within the cavity 20. Alternatively, some other connecting material such as Velcro® may be used to hold the clock within the cavity.

Figure 4:
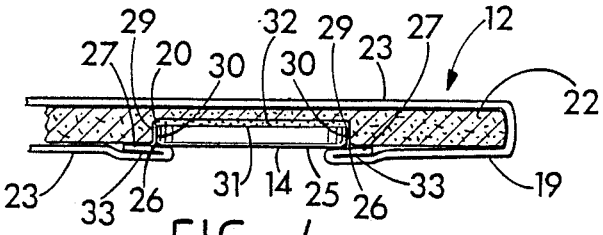
Figure 5:
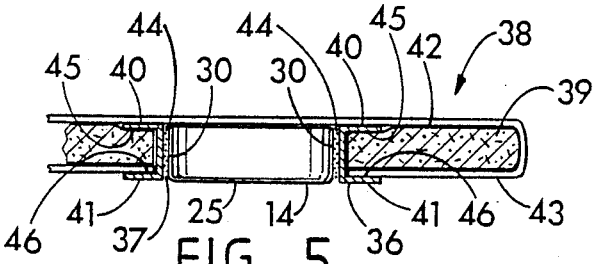
Figure 6:
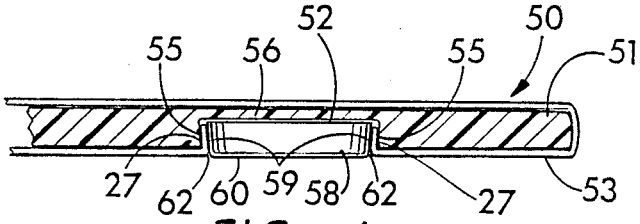

FIGS. 4–6 are longitudinal section views, analogous to the view shown in FIG. 3, of the visor portions of alternative timekeeping caps. The structure of the visor portions and/or clocks in FIGS. 4–6 varies from that shown in FIG. 3. In FIG. 4, the flaps 27 near the peripheral portions of the cavity are folded under the layer of material 23 and sewn thereto to form hem portions 33 which overlie the peripheral portions 26 of the cavity 20 to obscure the cavity sides 29 and clock sides 30. Additionally, the hem portions 33 are an alternative way of ensuring that there are no exposed cut edges on the layer of material 23.

FIG. 5 shows another alternative visor portion 38 in which the clock 14 is fit into a frame 36 within the cavity 37 which extends all the way through the core 39. The cardboard core 39 is covered by the layer of cloth material 23 except where the cavity 37 opens to the lower surface 43 of the visor portion 38. A thin metallic or plastic frame 36 which holds the clock within the cavity 37 includes upper flanges 40 and lower flanges 41 which hold the frame 36 in position within the cavity 37. The upper flanges 40 have undersides 45 which overlie the core 39 beneath the layer of material 23 around the cavity 37 to prevent downward movement of the frame. The layer of material 23 obscures the frame 36 and clock 14 on the top surface 42 of the visor portion 38. The lower flanges 41 cover both the core 39 and the layer of cloth material 23 so that there are not any exposed ends of the layer of material 23. The lower flanges 41 also have undersides 46 which prevent upward movement of the clock 14 and frame 36. The clock face 25 and lower flanges 41 are substantially flush with the lower surface 43 of the visor portion 38. The clock 14 may be adhered to the frame 36 with an adhesive 44, or otherwise attached to the frame 36. Alternatively, the frame 36 could be formed as an integral part of the clock 14. Similarly, a clock might have flexible tabs similar to the upper flanges 40. These tabs would be flexible so as to allow them to be pushed into the cavity and between the core 39 and layer of cloth material 23 at the top surface 42 of the visor portion 38.

FIG. 6 shows yet another alternative of the timekeeping cap. As shown, the visor portion 50 of the cap includes a plastic molded core 51 which is substantially covered by a layer of cloth material 23 except where the cavity 52 opens to the lower surface 53 of the visor portion 50. The cavity 52 has cavity sides 55 which are inwardly beveled in a direction toward the lower surface 53 of the visor portion 50 to which the cavity 52 opens. The clock 58 includes clock sides 59 which are beveled inwardly toward the clock face 60. Thus once the clock 58 is snapped into place within the cavity 52, the cavity sides 55 directly or indirectly abut against the clock sides 59 to maintain the clock 58 within the cavity 52. Preferably the flaps 27 formed from the layer of material 23 around the peripheral portions 62 of the cavity 52 extend into the cavity 52 pinched between the cavity sides 55 and clock sides 59 so that no cut ends of the layer of material 23 are exposed. The clock face 60 may be substantially flush with the lower surface 53 of the visor portion 50 as shown. As shown in FIG. 6, the core 51 may be thermoformed from plastic. Alternatively, the core 51 may be formed from any relatively rigid material which holds its shape fairly well.

Although the shape of the clock shown herein is rectangular, alternatively the clock may be round or even some other shape. The clock preferably will be a digital LCD clock which can operate for years on a single battery. The clock face preferably is oriented so that when an individual takes the cap off his or her head so that the visor portion faces toward the individual, the clock face is upright so that the individual can read the clock. Although the clock faces shown in FIGS. 1–6 are all substantially flush with the lower surface of the visor portion, alternatively the clock might project substantially out of the cavity. In such an alternative, the clock face might even be tilted to face slightly toward the individual's eyes while the cap is on his/her head, so the individual can view the time without removing the cap. The location of the clock on the visor portion of a cap will inherently protect the clock from interference with other objects, since the individual wearing the cap will tend to keep the visor portion away from those objects, and also will guard the space around his/her eyes.

The timekeeping cap 10 shown and described herein is particularly useful for individuals who work or participate in sports outdoors and are unable to wear a watch due to the nature of their activity. The timekeeping cap 10 both shades the individual's eyes from the sun and functions as a watch. The timekeeping cap is unlikely to interfere with any work which is performed with the hands, and therefore will not expose the clock to damage or being caught by machinery, equipment or other objects.

It is to be understood that the present invention is not limited to the particular arrangement and embodiment of parts disclosed and illustrated herein, but embraces all such modified forms thereof as come within the scope of the following claims.

What is claimed is:

1. A timekeeping cap comprising:

(a) a crown portion which may be placed and worn on a human head;

(b) a visor portion which extends from the crown portion for shade, the visor portion including a lower surface, a relatively stiff core, and a layer of material substantially covering the core, and having a cavity which opens to the lower surface; and (c) a clock which is positioned substantially within the cavity and which includes a clockface through which time may be viewed; wherein near peripheral portions of the cavity the layer of material forms flaps which extend at least partially into the cavity between the clock and core.

2. A timekeeping cap comprising:

(a) a crown portion which may be placed and worn on a human head;

(b) a visor portion which extends from the crown portion for shade, the visor portion including a lower surface, a relatively stiff core and a layer of material substantially covering the core, and having a cavity which opens to the lower surface; and (c) a clock which is positioned substantially within the cavity and which includes a clockface through which time may be viewed, and near peripheral portions of the cavity the layer of material forms flaps which extend at least partially into the cavity between the clock and core, wherein the layer of material includes hem portions overlying peripheral portions of the cavity and clockface, said hem portions being formed by the layer of material being folded back onto itself and being attached together.

3. A timekeeping cap comprising:

(a) a crown portion which may be placed and worn on a human head;

(b) a visor portion which extends from the crown portion for shade, the visor portion including a lower surface, a relatively staff core and a layer of material substantially covering the core, and having a cavity which opens to the lower surface;

(c) a clock which is positioned substantially within the cavity and which includes a clockface through which time may be viewed; and (d) means for retaining the clock within the cavity, said retaining means comprising an adhesive between the core and a portion of the clock which substantially abuts against the core within the cavity.

4. A timekeeping cap comprising:

(a) a crown portion which may be placed and worn on a human head;

(b) a visor portion which extends from the crown portion for shade, the visor portion including a lower surface and having a cavity which opens to the lower surface;

(c) a frame which includes a peripheral flange portion which extends outwardly from the cavity to overlie the lower surface of the visor portion; and (d) a clock which is positioned substantially within the cavity and which includes a clockface through which time may be viewed.

5. The timekeeping cap of claim 4 wherein said frame is attached to the clock to restrain the clock from moving in a direction which an underside of the flange portion faces.

6. A timekeeping cap comprising:

(a) a crown portion which may be placed and worn on a human head;

(b) a visor portion which extends from the crown portion for shade, the visor portion including a lower surface and having a cavity with sides and which opens to the lower surface; and (c) a clock which is positioned substantially within the cavity and attached to the sides and which includes a clockface through which time may be viewed.

7. A timekeeping cap comprising:

(a) a crown portion which may be placed and worn on a human head;

(b) a visor portion which extends from the crown portion for shade, the visor portion including a lower surface and having a cavity which opens to the lower surface, wherein the cavity is formed with cavity sides which are inwardly beveled in a direction toward the lower surface of the visor portion; and (c) a clock which is positioned substantially within the cavity and which includes a clockface through which time may be viewed, and the clock has clock sides which are beveled inwardly toward the clockface, so that the clock may be snapped into the cavity wherein the cavity sides will maintain the clock within the cavity by abutting against the clock sides.

* * * * *